US008857013B2

(12) United States Patent
Kooijman et al.

(10) Patent No.: US 8,857,013 B2
(45) Date of Patent: Oct. 14, 2014

(54) VACUUM CLEANING DEVICE, COMPRISING A UNIT WITH A MOVABLE SURFACE FOR GENERATING AN OSCILLATING AIRFLOW

(75) Inventors: Gerben Kooijman, Eindhoven (NL); Jan Frederik Suijver, Eindhoven (NL); Yvonne Wendela Kruijt-Stegeman, Eindhoven (NL); Jeroen Herman Lammers, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 41 days.

(21) Appl. No.: 13/821,258

(22) PCT Filed: Sep. 21, 2011

(86) PCT No.: PCT/IB2011/054138

§ 371 (c)(1),
(2), (4) Date: Mar. 7, 2013

(87) PCT Pub. No.: WO2012/038901

PCT Pub. Date: Mar. 29, 2012

(65) Prior Publication Data

US 2013/0160230 A1 Jun. 27, 2013

(30) Foreign Application Priority Data

Sep. 23, 2010 (EP) ..... 10178581

(51) Int. Cl.

| | |
|---|---|
| ***A47L 5/14*** | (2006.01) |
| ***A47L 5/30*** | (2006.01) |
| ***B08B 5/04*** | (2006.01) |
| ***A47L 5/20*** | (2006.01) |
| ***A47L 5/00*** | (2006.01) |
| *A47L 9/00* | (2006.01) |

(52) U.S. Cl.

CPC ... *A47L 5/20* (2013.01); *B08B 5/04* (2013.01); *A47L 9/0072* (2013.01); *A47L 9/0081* (2013.01); *A47L 5/00* (2013.01); *A47L 5/30* (2013.01); *A47L 5/14* (2013.01)

USPC ..... 15/363; 15/345; 15/346; 15/404

(58) Field of Classification Search

USPC ..... 15/345, 346, 363, 404

IPC ..... A47L 5/14,5/30, 9/04

See application file for complete search history.

(56) References Cited

U.S. PATENT DOCUMENTS 4,018,483 A 4/1977 Smith
5,400,466 A * 3/1995 Alderman et al. ..... 15/363

(Continued)

FOREIGN PATENT DOCUMENTS

FR 2541701 A1 8/1984
GB 2393384 A 3/2004

OTHER PUBLICATIONS

J.M. Shuster and D.R. Smith; A Study of the Formation and Scaling of a Synthetic Jet; AIAA Paper, Paper 2004-0090, 2004.

(Continued)

*Primary Examiner* — David Redding

(57) ABSTRACT

A vacuum cleaning device comprises a unit (1) in which an oscillating airflow is generated which substantially zero net flow and an asymmetry between the suction and the blowing phases, such that in the blowing phase a jet is generated. A generator (31) which is needed for generating the oscillating airflow comprises a movable surface (30) which is integrated in a wall (12) of a housing (10) having an internal space (11) and at least one opening (13) for allowing air to flow to and from the internal space (11). The jet can be generates when the so-called Strouhal number, being the frequency of the movement of the movable surface (30) multiplied by a characteristic dimension of the opening (13) and divided by the velocity of the air in the opening (13), is not higher than a predetermined maximum.

15 Claims, 5 Drawing Sheets

(56) References Cited

U.S. PATENT DOCUMENTS

| | | | | |
|---|---|---|---|---|
| 7,383,607 | B2 | 6/2008 | Johnson | |
| 2005/0278890 | A1 * | 12/2005 | Bosses | 15/363 |
| 2008/0289657 | A1 | 11/2008 | Arjomand | |

OTHER PUBLICATIONS

R. Holman, Y. Utturkar et al, Formation Criterion for Synthetic Jets; AIAA Journal, vol. 43(10), pp. 2110-2116, 2005.

* cited by examiner

VACUUM CLEANING DEVICE, COMPRISING A UNIT WITH A MOVABLE SURFACE FOR GENERATING AN OSCILLATING AIRFLOW

FIELD OF THE INVENTION

The present invention relates to a vacuum cleaning device, comprising a unit for aerodynamically affecting dust particles and/or a surface to be cleaned in order for the particles to become dislodged from the surface and to become airborne.

BACKGROUND OF THE INVENTION

Vacuum cleaning is a well-known method for removing dust from surfaces, particularly floors. In general, in the field of vacuum cleaning, a suction force is generated and applied for forcing dust and particles to move from a surface to be cleaned to another location such as a canister for collecting the particles. In the process, it may be desirable to agitate the surface in order to facilitate removal of the particles from the surface under the influence of the suction force as mentioned. To that end, it is possible to use a tool for actually contacting the surface to be cleaned. However, it is also known to use another technique, namely a technique which involves the use of a kind of air pump, wherein air waves are generated for vibrating the surface, which can help in releasing dust particles from the surface.

U.S. Pat. No. 7,383,607 discloses an agitation apparatus which is suitable for use in a cleaning head of a vacuum cleaner, and which includes first and second flow paths. Each of these flow paths has a resonant cavity and an inlet/outlet port which joins the cavity to a space within the cleaning head. A generator, such as a loudspeaker with a diaphragm, generates an alternating pressure wave between the ports. Pressure waves are emitted from one of the ports in an anti-phase relationship with the pressure waves from the other of the ports, thus reducing operating noise. When the vacuum cleaner of which the agitation apparatus is part is used for cleaning a carpet, the air motion to/from the ports vibrates the pile of the carpet and serves to draw out dust from between the carpet fibers.

U.S. Pat. No. 7,383,607 teaches that in the known agitation apparatus, the frequency of the oscillating airflow is preferably chosen such as to be at the resonant frequency of the carpet to be cleaned. Therefore, it is preferred if the frequency of operation is variable.

It is noted that the agitation apparatus known from U.S. Pat. No. 7,383,607 helps in releasing dust from a carpet, but it is not capable of effectively freeing dust from inside a carpet and making it airborne. This cannot be done by only causing a vibration as mentioned, even if a frequency at which the vibration takes place is in the resonant range. Furthermore, when the known agitation apparatus is used, there is always a need for an additional system for actually forcing the dust to move away from the carpet, namely a conventional system comprising a motor and a fan for generating a suction force.

Another apparatus for dislodging and conveying material from a surface and into a discharge duct is known from U.S. Pat. No. 4,018,483. In particular, the known apparatus is adapted to convey material under the influence of a positive pressure, high velocity stream of fluid from a jet device. The fluid stream is controlled by using wall attachment means comprising an unenclosed coanda surface located adjacent to the jet device and disposed on a side of the stream opposite to that of the material to be conveyed, whereby the stream attaches to the coanda surface, and the stream and entrained material are directed along the coanda surface and into the discharge duct, and then directed into a collection device.

SUMMARY OF THE INVENTION

It is an object of the present invention to provide a vacuum cleaning device comprising a unit for freeing dust from a surface to be cleaned which is much more effective than devices according to the state of the art, in particular the device known from U.S. Pat. No. 7,383,607 as described in the foregoing, and which offers a possibility of omitting the conventional suction system in the vacuum cleaning device. The object is achieved by means of a vacuum cleaning device which comprises a unit for aerodynamically affecting dust particles and/or a surface to be cleaned in order for the particles to become dislodged from the surface and to become airborne, wherein the unit comprises a housing having an internal space enclosed by a housing wall in which at least one opening is arranged, a movable surface which is integrated in the housing wall, and means for actuating the movable surface, which are adapted to realize an oscillating movement of the surface that causes air to alternately be drawn into the housing through the opening from various directions at the opening, and expelled from the housing through the opening in the form of a directed jet.

When the present invention is applied, the movable surface which is part of the unit, and which is used for generating air waves, is actuated in such a way that there is an asymmetry between the suction and the blowing phases. Upon inflow, air is drawn from various directions into the housing of the unit, and upon outflow, a directed jet of air is formed. In fact, the unit which is part of the vacuum cleaning device according to the present invention may be regarded as means for generating a so-called synthetic jet. The insight that a synthetic jet can be used in the field of vacuum cleaning is an achievement of the present invention. According to the present invention, the oscillating synthetic airflow is used to aerodynamically affect dust particles and/or a surface to be cleaned such that the particles are dislodged from the surface and become airborne. Furthermore, it is possible to use the outgoing directed jet of air for transporting dust particles to a desired position, wherein the traditional suction airflow generated by a fan or the like may be omitted.

At a given vibration frequency and a given geometry of the opening in the wall of the housing of the unit, the directed jet of air is formed when the velocity of the air through the opening is high enough. A generally known number which is applicable here is the so-called Strouhal number, which is defined as follows:

$$Sr = \frac{f * d}{v}$$

in which Sr is the Strouhal number, f is a frequency of the movement of the surface which is part of the unit, d is a characteristic dimension of the opening, and v is an average velocity of the air in the opening in an outflow phase of a cycle of drawing in and expelling air. Generally speaking, for the purpose of ensuring that a synthetic jet is realized, it is advantageous if the Strouhal number is below a certain maximum, wherein the value of this maximum is related to the characteristics of the opening concerned, particularly the shape of the opening. If the opening is an axis-symmetric opening, for example, a circular opening, it is preferred if the following criterion is met: $Sr \leq 1$, and it is more preferred if the following criterion is met: Sr≤0.5. In that case, the diameter of the opening is the characteristic dimension. Furthermore, if the opening has an elongated rectangular shape, with a long side which is at least 10 times longer than a short side, it is preferred if the following criterion is met: Sr≤0.25, and it is more preferred if the following criterion is met: Sr≤0.1. In that case, the length of the short side of the opening is the characteristic dimension. In general, it is preferred if the Strouhal number Sr is not higher than 1.

In principle, the opening can have any suitable shape. An example of another possibility than an axis-symmetric shape and an elongated rectangular shape is a square shape. In that case, the length of a side of the opening is the characteristic dimension. When designing an opening with a square shape, it is practical to make use of the criterion which is applicable to the case of the axis-symmetric shape. When designing an opening with a rectangular shape which is not necessarily an elongated rectangular shape, and also not a square shape, it is a feasible option to make use of the criterion which is applicable to the case of the elongated rectangular shape.

For sake of completeness, it is noted that the following two publications are relevant in the field of jet formation criteria:

R. Holman, Y. Utturkar, R. Mittal, B. L. Smith, and L. Cattafesta; Formation Criterion for Synthetic Jets; AIAA Journal, vol. 43(10), pp. 2110-2116, 2005; and J. M. Shuster, and D. R. Smith; A Study of the Formation and Scaling of a Synthetic Jet; AIAA Paper 2004-0090, 2004.

With the present invention, contrary to the state of the art known from U.S. Pat. No. 7,383,607, there is no focus on vibrating a surface to be cleaned, and adjusting the frequency of operation such as to realize vibrations which are most effective. Instead, it is important to realize characteristics of geometry and actuation/operation for having a synthetic jet, wherein there is asymmetry in the airflow. In the outflow phase, a directed jet is formed, which is far more effective for dislodging dust particles from a carpet or another surface to be cleaned than the known airflow, which is mainly used for realizing a vibration effect. Moreover, the directed jet can be used for transporting dust particles to a desired position.

In a practical embodiment, the housing which is part of the unit may comprise a tube-shaped portion, wherein the opening is present at an end thereof. The tube-shaped portion may help in determining a direction of the outgoing jet of air.

In general, the unit may comprise means for guiding air that is expelled from the housing during operation toward the opening. According to a first possibility, these means may especially be suitable for guiding the air in a direction of another portion of the unit. In such a case, it may be so that during a process of cleaning a carpet, dust is sucked out of the carpet pile during the intake phase, and transported to the designated other portion of the unit during the outflow phase. During this latter phase, it may be so that entrainment takes place, which causes additional dust to be removed out of the carpet. Furthermore, in such a case, it is advantageous if the guiding means have a specific orientation, i.e. an orientation which causes the outgoing jet to be directed away from the carpet, wherein an angle between the jet and the carpet is in a range of 0° to 40°. The angle may even be larger than 40°. Speaking in terms of the construction of the unit, there may be a planar area at the outside of the unit for guiding the unit over a surface to be subjected to a vacuum cleaning process, wherein the guiding means may be orientated at an angle which is in a range from 0° to 40° with respect to the planar area as mentioned. The planar area is suitable for facing a carpet or another surface to be cleaned and ensuring that the unit is properly positioned with respect to the surface concerned during use.

Besides the first possibility as described in the foregoing, there is a second possibility for the guiding means, namely a possibility according to which the guiding means are capable of guiding the air both toward the opening and in a direction to the outside of the unit. In such a case, the synthetic jet can be used for opening the carpet and removing dust from the carpet by a direct blowing action. Furthermore, the orientation of the guiding means may be such that an angle with respect to a surface to be cleaned is in a range from 0° to 40°. The angle may even be larger than 40°. This is especially applicable when the surface to be cleaned is a hard floor.

A projection may be arranged at the outside of the unit, at an opening for allowing access to the inside of the unit, so that a process of opening the carpet is performed in a mechanical way. It will be understood that opening the carpet contributes to the effectiveness of dust removal.

It is possible for the unit to comprise two times an internal space enclosed by a housing wall in which at least one opening is arranged, wherein a portion of the housing wall is arranged inside of the housing and constitutes a separation between the two internal spaces, and wherein the movable surface is arranged in that particular housing wall portion. In that case, there are at least two outflow tracts, which may be in anti-phase to reduce sound volume, in a way as known from U.S. Pat. No. 7,383,607, for example.

In another possible embodiment, the unit comprises an additional housing having an internal space enclosed by a housing wall in which at least one opening is arranged, wherein the internal spaces of the housings are in communication with each other through the openings. In this embodiment, the additional housing may be used for receiving dust that is agitated by the airflow from the housing having the movable surface. Advantageously, the internal spaces of both housings are in communication with an opening in the unit for allowing access to the inside of the unit, through their openings, so that air can freely flow between the internal spaces of each of the housings and a surface to be cleaned as well as between the internal spaces of the housings.

When the unit has two housings as mentioned, it may be so that each of the housings has two openings, wherein the internal spaces of the housings are in communication with each other through these openings, i.e. at two positions. In that case, an additional connection between the internal spaces of the housings may be used for inducing a net flow in the additional housing by entrainment under the influence of a synthetic jet generated by the movable surface in the other housing. When the additional housing is used for receiving dust, as mentioned in the foregoing, the induced flow helps in transporting the dust. It may even be so that there is no need for an application of separate means for generating a transport flow, so that the power requirement of the unit may be very low.

A portion of the wall of the additional housing may be recessed at the inside of the housing, in order to avoid a situation in which dust can move back and forth in the housing under the influence of the oscillating airflow. When the dust moves back, it is retained by the recess.

The additional housing may have an opening that is open to a space outside of the unit. This is another way of realizing a transport flow which does not require much power, because the transport flow is not drawn over a surface to be cleaned, which may result in power loss, especially in case the surface is a carpet, but is drawn directly from a space outside of the unit.

The unit may comprise more than one housing having a movable surface. In such a case, a situation may be obtained in which different synthetic jets simultaneously blow onto a surface to be cleaned and eject into another portion of the unit, for example. Furthermore, in such a case, it is possible to incorporate a way of switching between various modes of operation of the combination of the housings having a movable surface, dependent on characteristics of the surface to be cleaned, for example.

It is possible to use a filter for protecting the internal space of the housing and the opening from contamination. When this is done, the risk of too much dust entering the space and damaging the movable surface inside is minimized, while the air flow characteristics are maintained.

Within the context of the present invention, many practical embodiments are feasible, wherein the directed jet from the housing of the unit may be used for various purposes which are advantageous in the field of vacuum cleaning.

The above-described and other aspects of the present invention will be apparent from and elucidated with reference to the following detailed description of a number of embodiments of a unit which is intended to be used in a vacuum cleaning device.

BRIEF DESCRIPTION OF THE DRAWINGS

The present invention will now be explained in greater detail with reference to the figures, in which equal or similar parts are indicated by the same reference signs, and in which.

DETAILED DESCRIPTION OF EMBODIMENTS

Figure 1:
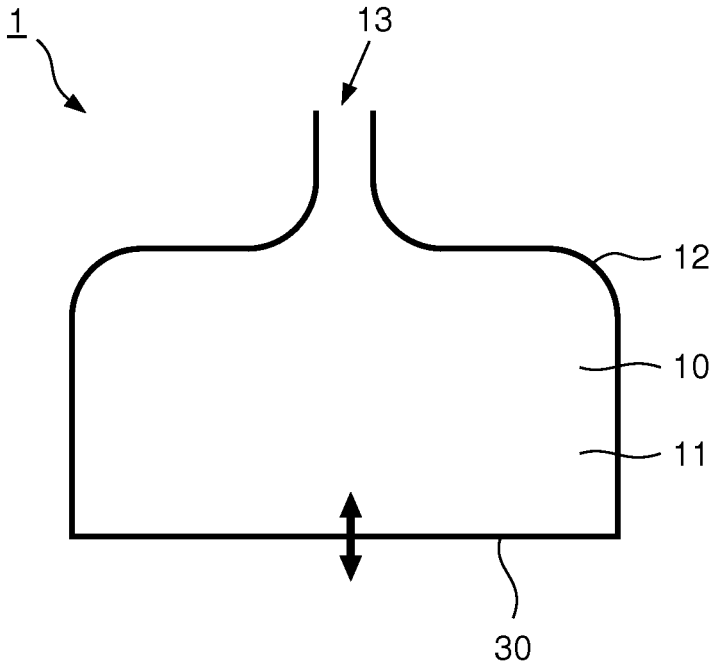
FIG. 1 diagrammatically shows a basic layout of a unit which is intended to be used in a vacuum cleaning device.

FIG. 1 diagrammatically shows a basic outline of a unit 1 which is intended to be used in a vacuum cleaning device, and serves to illustrate the essence of the operation of the unit 1. In a vacuum cleaning device (not shown in the figures), the unit 1 is used at the position of a nozzle of the device where the action of removing dust from a surface to be cleaned takes place. In the following, it is assumed that the surface to be cleaned is a carpet, which does not alter the fact that the unit is applicable with other types of surfaces as well. In view of the intended use of the unit 1, the unit 1 will hereinafter also be referred to as vacuum cleaning unit 1.

For sake of completeness, it is noted that it is a well-known fact that a vacuum cleaning device serves for removing dust from a surface to be cleaned, which is normally a floor surface. Besides a nozzle for taking in the dust, a conventional vacuum cleaning device comprises means for inducing a suction force at the position of the nozzle and along an internal path from the nozzle to a point for collecting the dust, and means for separating dust from air. In many cases, the nozzle is connected to the dust collection point through suitable tubing.

FIG. 1 illustrates the fact that the vacuum cleaning unit 1 comprises a housing 10 having an internal space 11 enclosed by a housing wall 12. The housing 10 can have various shapes and sizes, depending on the particulars of an exact situation. In any case, at least one opening 13 is arranged in the housing wall 12, which can have various shapes and sizes as well. Also, there is a movable surface 30 which is integrated in the housing wall 12. In practical cases, the movable surface 30 can comprise a flexible membrane or the like, and can be part of a loudspeaker-like device, as diagrammatically shown in FIG. 2, or any other suitable type of device in which means for actuating the movable surface 30 are arranged. For example, the movable surface 30 may be an end surface of a piston, or a surface of piezo material.

When the vacuum cleaning unit 1 is operated and the means for actuating the movable surface 30 are made to perform their function, the movable surface 30 is moved at its position in the housing wall 12. The actuating means are adapted to realize a back and forth movement of the surface 30, such that an oscillating airflow is obtained. It is noted that in FIG. 1, the back and forth movement of the surface 30 is indicated by means of a two-headed arrow.

The back and forth movement alone does not generate a net airflow. During a blowing phase, i.e. a phase in which air is made to flow out of the opening 13, there is flow detachment at the position of the opening 13. According to the present invention, the operation of the actuating means and the geometry of the housing 10 are adapted to each other in such a way that the detached flow is realized with a sufficiently small Strouhal number, which is determined by a relation between a frequency of the movement of the surface 30, a characteristic dimension of the opening 13, and an average velocity of the air in the opening 13 in an outflow phase of a cycle of drawing in and expelling air, as follows:

$$Sr = \frac{f * d}{v}$$

in which Sr is the Strouhal number, f is the frequency as mentioned, d is the characteristic dimension as mentioned, and v is the velocity as mentioned. In case the opening 13 is an axis-symmetric opening, a value of 0.63 is a practical example of the maximum Strouhal number Sr, and in case the opening 13 has an elongated rectangular shape, a value of 0.075 is a practical example of the maximum Strouhal number Sr.

In respect of the average velocity v of the air in the opening 13, it is noted that in practice, the velocity can be expected to have a certain distribution over the opening 13, and to vary during an outflow phase of a cycle. Therefore, in practice, the velocity v may be determined as the velocity v which is found as the average of various values inside the opening 13, over an entire area of the opening 13, as an average during the outflow phase. The velocity v is determined by various factors, including characteristics of the vibrating motion of the surface 30 and geometry of the housing 10. In the context of this geometry, there are other determining factors, such as the size of the surface 30, the dimensions of the opening 13, and the volume of the internal space 11 of the housing 10. The velocity v can be determined in any suitable way, including using an algorithm or performing measurements. Hence, it is possible to carry out the present invention and design a vacuum cleaning unit 1 in which the criterion in respect of the Strouhal number Sr is met.

Figure 2:
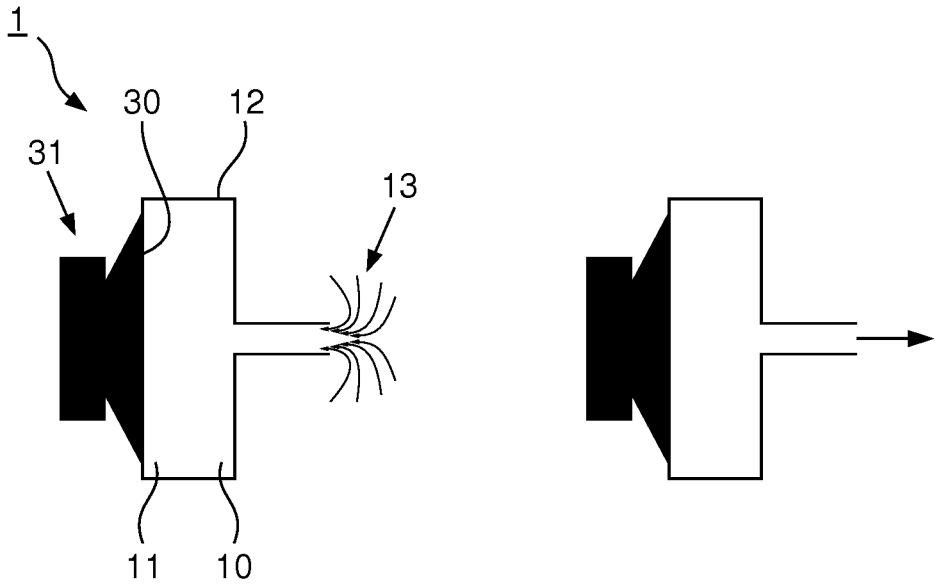
FIG. 2 illustrates an ingoing flow and an outgoing flow of air which are generated in two different stages of operation of the unit.

The vibrating motion of the surface 30 causes air to be alternately drawn into the internal space 11 of the housing 10 from the ambient, and expelled again into the ambient. By having the sufficiently small Strouhal number Sr, it is achieved that there is asymmetry between the suction and the blowing phases. This fact is illustrated in FIG. 2, in which directions of airflows are indicated by means of arrows. On the left side of FIG. 2, it can be seen that upon inflow, air is drawn from all directions into the internal space 11 of the housing, and on the right side of the FIG. 2, it can be seen that upon outflow, a directed jet of air is formed.

According to the present invention, the oscillating jet flow is used at the nozzle of a vacuum cleaning device to aerodynamically affect dust particles and/or the carpet, so that the dust is dislodged from the carpet and becomes airborne. Different embodiments showing how the jet flow can be applied for realizing desirable effects in a vacuum cleaning device will be explained in later on, on the basis of FIGS. 3 to 10.

As far as the vacuum cleaning unit 1 is concerned, many variations on the basic implementation as described in the foregoing are feasible. In the following, only a few of the many possible examples are mentioned. The housing 10 may have more openings 13, so that multiple jets can be created. The back of the movable surface 30 may be arranged in an airtight enclosure in order to raise its resonance frequency. Also, the back of the surface 30 can be coupled to one or more openings 13 in a housing 10 as well to create more jets. As the jets which are generated by the front and the back of the surface 30 are in anti-phase, the advantage of minimizing radiated sound is obtained. For the same purpose, multiple jets generated by multiple movable surfaces 30 driven in anti-phase can be employed. Conversely, a multitude of movable surfaces 30 may be contained in a single housing 10 and be coupled to a single opening 13.

FIGS. 3-10 serve to illustrate practical embodiments of the vacuum cleaning unit 1. Basically, in the embodiments, there are two different modes of using the oscillating jet flow at the position of a nozzle of a vacuum cleaning device. In the first place, the entirety of the movable surface 30 and the means for actuating the surface 30, which will hereinafter be referred to as synthetic jet generator 31, can be used to suck up dust at inflow, and subsequently eject it towards a dust collection point such as a bag at jet outflow. In the second place, the jet can be directed towards the carpet instead, in order to dislodge dust by blowing. A combination of the two modes in one embodiment is also a possibility.

Figure 3:
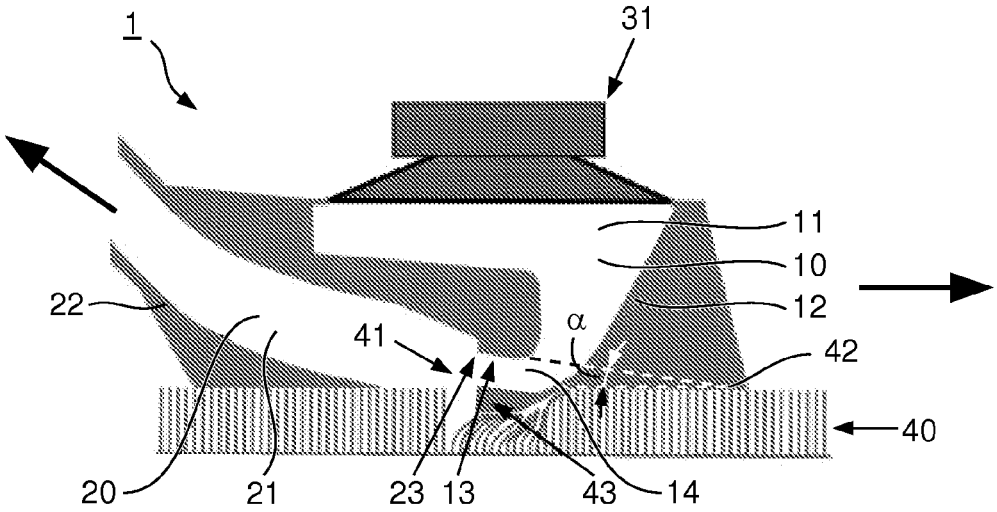
FIG. 3 diagrammatically shows a sectional view of a first practical embodiment of the unit.
Figure 4:
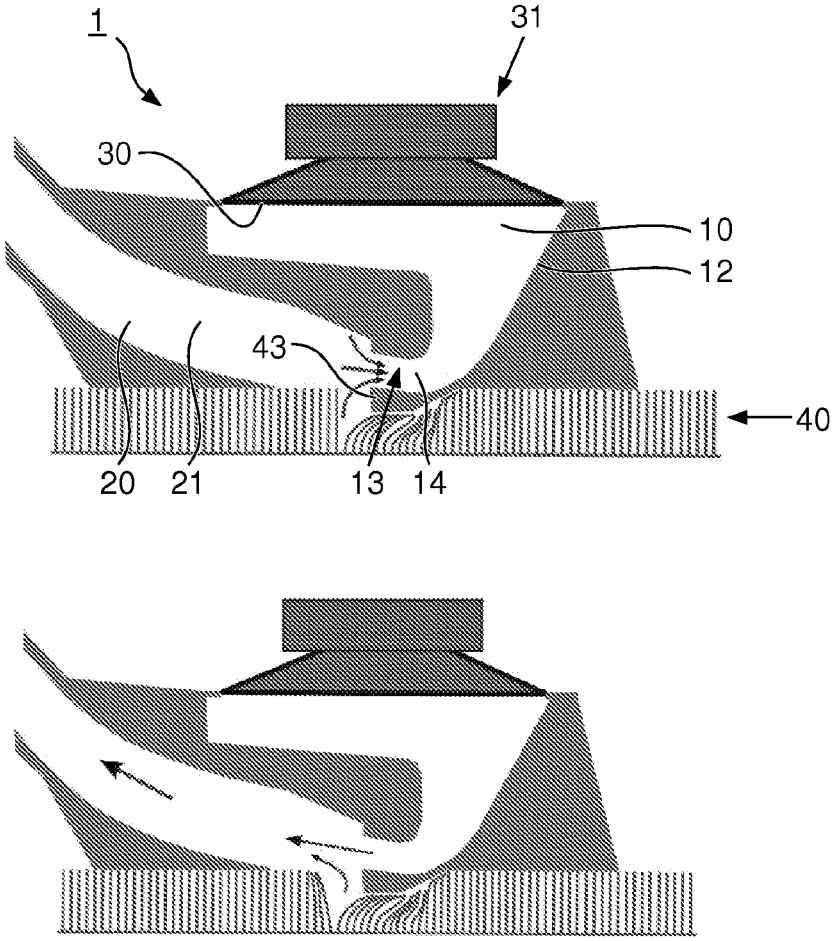
FIG. 4 illustrates flows of air which are generated during two different stages of operation of the unit shown in FIG. 3.

A basic embodiment of the vacuum cleaning unit 1, in which the oscillating airflow is directed towards a dust collection point is shown in FIG. 3. The dust collection point is not shown in the figure, but an arrow pointing in the direction of this point can be seen at the left side of the figure. A direction in which the unit 1 is preferably moved across the carpet 40 is indicated by means of an arrow which can be seen at the right side of the figure.

In the shown example, the vacuum cleaning unit 1 comprises two housings 10, 20, namely a housing 10 as described earlier, which is associated with the synthetic jet generator 31, and a housing 20 which is used for receiving a directed jet flow from the first-mentioned housing 10. For sake of clarity, the first housing 10 will be referred to as jet generator housing 10, and the second housing 20 will be referred to as suction channel housing 20. The jet generator housing 10 has the internal space 11, the housing wall 12, and the opening 13 in the housing wall 12 as described in the foregoing. In the shown example, the opening 13 is arranged at the end of a tube-shaped portion 14 of the housing 10, which will hereinafter be referred to as flow channel 14. The suction channel housing 20 has an internal space 21, a housing wall 22, and an opening 23 in the housing wall 22 that is in communication with the opening 13 of the jet generator housing 10. Thus, when a directed jet flow is expelled from the jet generator housing 10, the flow reaches the internal space 21 of the suction channel housing 20 through the openings 13, 23 as mentioned.

For the purpose of allowing air to flow from the carpet 40 to the inside of the vacuum cleaning unit 1, an opening 41 is arranged in the unit 1 that provides access to the internal space 21 of the suction channel housing 20 at a position that is in the immediate vicinity of the openings 13, 23 through which the internal spaces 11, 21 of the two housings 10, 20 are in communication with each other. In the following, the opening 41 that is the interface between the inside of the unit 1 and the outside of the unit 1 will be referred to as unit opening 41. A portion 42 of an exterior surface of the unit 1 which is used for facing the carpet 40 and allowing the unit 1 to be positioned right above the carpet 40 is planar, whereas at the position of the unit opening 41, a lip 43 which is projecting somewhat with respect to the planar area 42 in the direction of the carpet 40 is provided. During operation and movement of the unit 1, the lip 43 serves to open the carpet pile, thereby facilitating the escape of dust from the carpet.

The flow channel 14, which has the opening 13 of the jet generator housing 10 at its end, extends just above the lip 43. During operation, the vibrating motion of the movable surface 30 that is incorporated in the housing wall 12 of the jet generator housing 10 establishes an oscillating flow in the flow channel 14. When air is drawn into that channel 14, is comes from all directions, as is depicted by means of arrows in the representation of the unit 1 on the left side of FIG. 4. When air is expelled again, flow separation causes it to flow out of the flow channel 14 as a directed jet, as is depicted by means of an arrow in the representation of the unit 1 on the right side of FIG. 4. The jet additionally entrains air from its surroundings, as indicated by another arrow in the representation of the unit 1 on the right side of FIG. 4.

When the movable surface 30 is made to perform a back and forth movement at its position in the housing wall 12 of the jet generator housing 10, dust is sucked out of the opened carpet pile into the flow channel 14 of the jet generator housing 10 during the intake phase, and ejected from the flow channel 14 into the internal space 21 of the suction channel housing 20, towards the dust collection point, during the jet outflow phase. Furthermore, during the jet outflow phase, entrainment causes additional dust to be removed out of the carpet 40. On average, no net airflow for dislodging dust is used. Only a small flow for dust transport from the unit opening 41 to the dust collection point, which may be induced by suitable means such as a fan (not shown) at the dust collection point, is required. This means that the flow through the carpet 40 and the system of the vacuum cleaning device (tubing, filters, etc.) is minimal, yielding substantially lower losses as compared to a traditional vacuum cleaning device in which one suction airflow is used for all processes which need to take place, including the removal of dust from a surface to be cleaned and the transport of the dust inside the device.

FIGS. 5-8 show alternatives to the embodiment of the vacuum cleaning unit 1 as shown in FIG. 3 and as described in the preceding paragraphs. Particulars of the alternative embodiments will be explained in the following.

Figure 5:
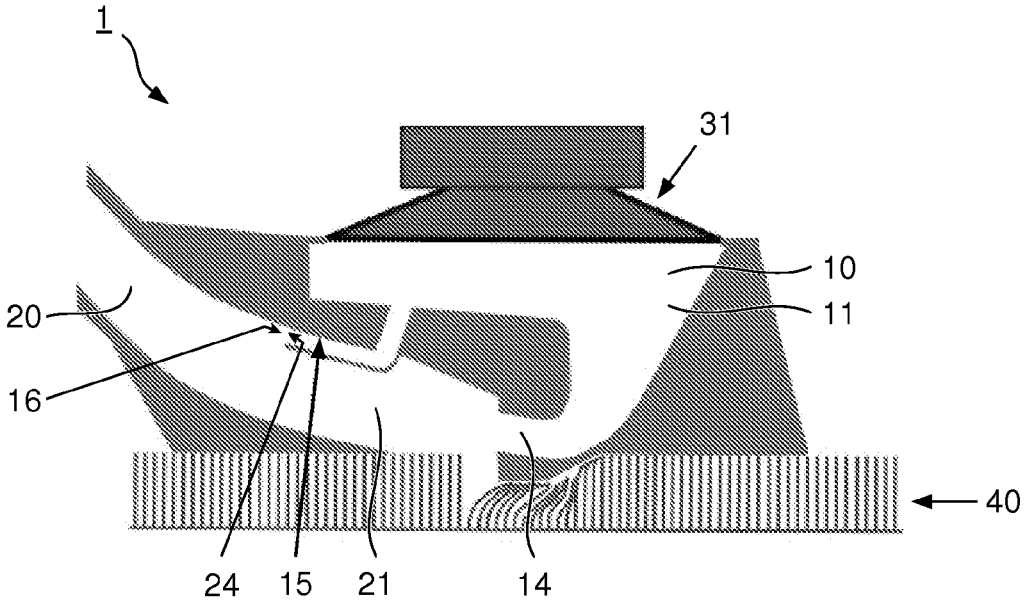
FIG. 5 diagrammatically shows a sectional view of a second practical embodiment of the unit.

FIG. 5 shows an embodiment with an additional flow channel 15 between the internal space 11 of the jet generator housing 10 and the internal space 21 of the suction channel housing 20. Hence, in this embodiment, the internal spaces 11, 21 as mentioned both have an additional opening 16, 24, and are in communication with each other at two positions. During operation of the synthetic jet generator 31, at the outlet of the additional flow channel 15, a jet is formed, inducing a net flow in the internal space 21 of the suction channel housing 20 by entrainment. In this embodiment, there is no need for a fan or the like to establish the net transport flow towards the dust collection point, whereby the total power requirement may be further reduced.

Figure 6:
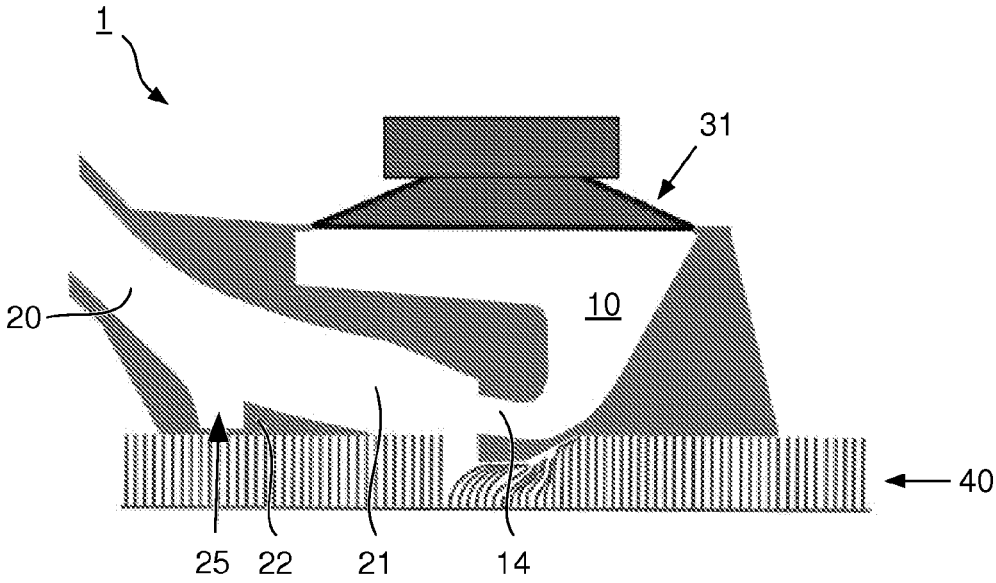
FIG. 6 diagrammatically shows a sectional view of a third practical embodiment of the unit.

FIG. 6 illustrates a possibility of having a recess 25 in the wall 22 of the suction channel housing 20. This recess 25 serves as a dust trap, preventing dust injected into the internal space 21 of the suction channel housing 20 to fall back between jet pulses. Alternatively, the recess 25 can also serve as a local dust reservoir for a hand stick type vacuum cleaning device, which would negate the additional fan for generating a transport flow as well.

Figure 7:
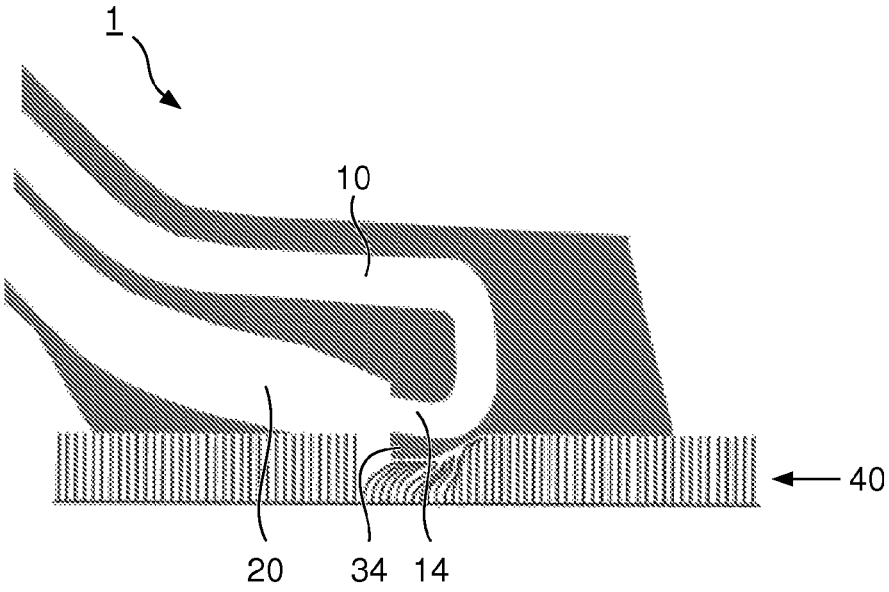
FIG. 7 diagrammatically shows a sectional view of a fourth practical embodiment of the unit.

FIG. 7 shows an embodiment in which the synthetic jet generator 31 for generating the jet flow above the lip 43 is positioned at a relatively large distance from the lip 43 and its surroundings as shown in the figure. For example, the synthetic jet generator 31 may be positioned at the dust collection point. In that case, the vacuum cleaning unit 1 can still have the required functioning when the movable surface 30 of the synthetic jet generator 31 is pneumatically connected to the flow channel 14 above the lip 43 by additional tubing.

Figure 8:
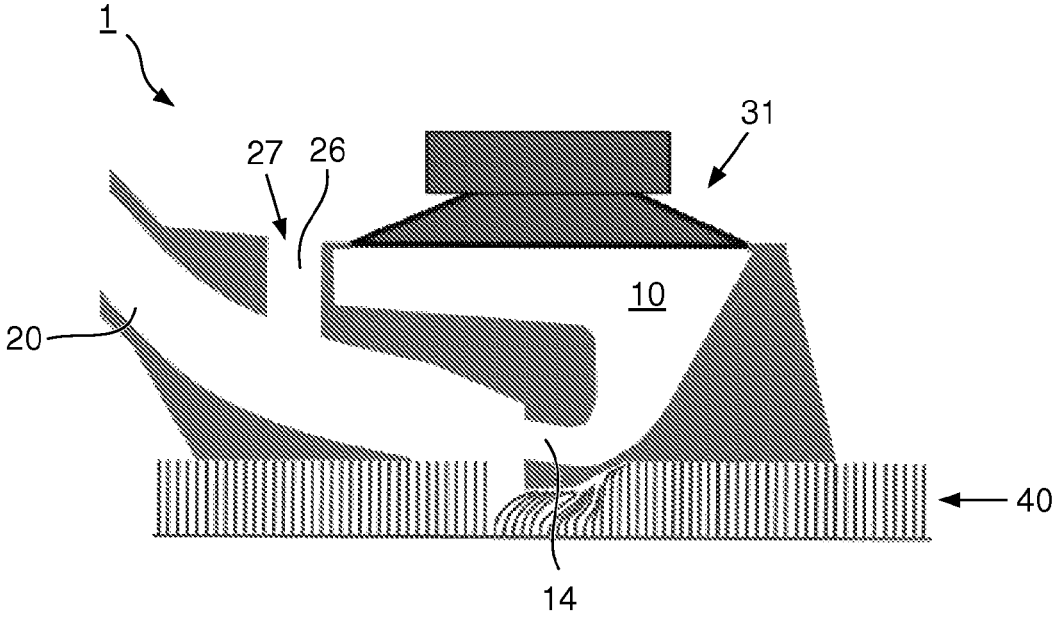
FIG. 8 diagrammatically shows a sectional view of a fifth practical embodiment of the unit.

FIG. 8 shows an embodiment in which the net flow for transporting the dust in the suction channel housing 20 is drawn directly from the exterior via a separate channel 26, through an opening 27 at the end of the channel 26. As the transport flow is not drawn through the carpet 40 anymore, losses will be further minimized.

Figure 9:
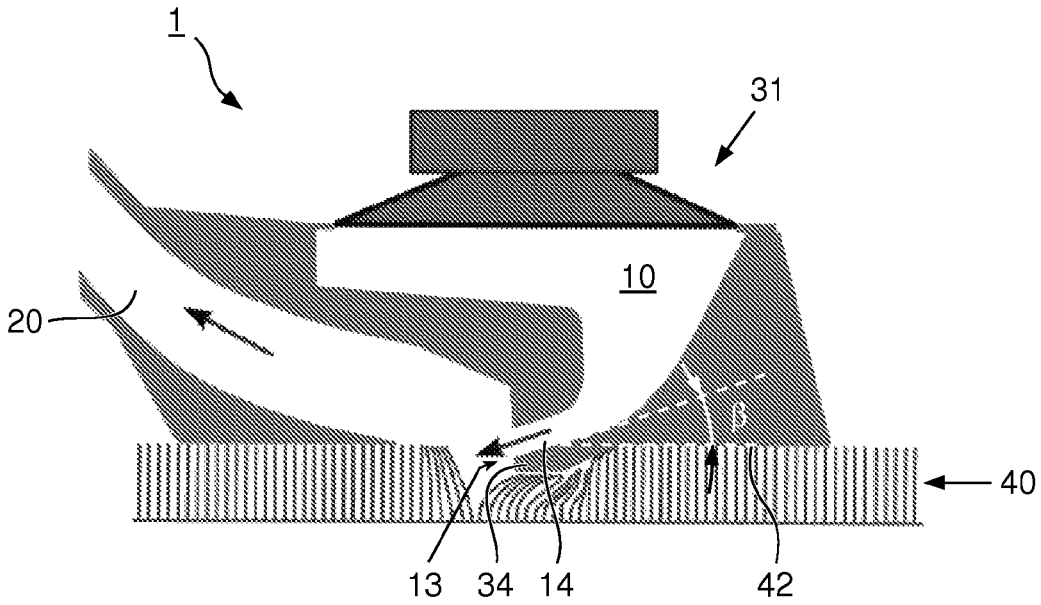
FIG. 9 diagrammatically shows a sectional view of a sixth practical embodiment of the unit.

In the above-described embodiments, the jet that is generated by the synthetic jet generator 31 is used for removing dust from the carpet 40 by entrainment, and possibly also for transporting the dust inside the vacuum cleaning unit 1. It is also possible for the jet to be directed towards the carpet 40 in order to dislodge dust by blowing. A basic embodiment of a unit 1 which is adapted to have the jet directed as mentioned is shown in FIG. 9. When the unit 1 according to this embodiment is operated, the jet has a function in opening the carpet pile, wherein it is possible to reduce or even omit the lip 43 for performing the same function in a mechanical manner.

Figure 10:
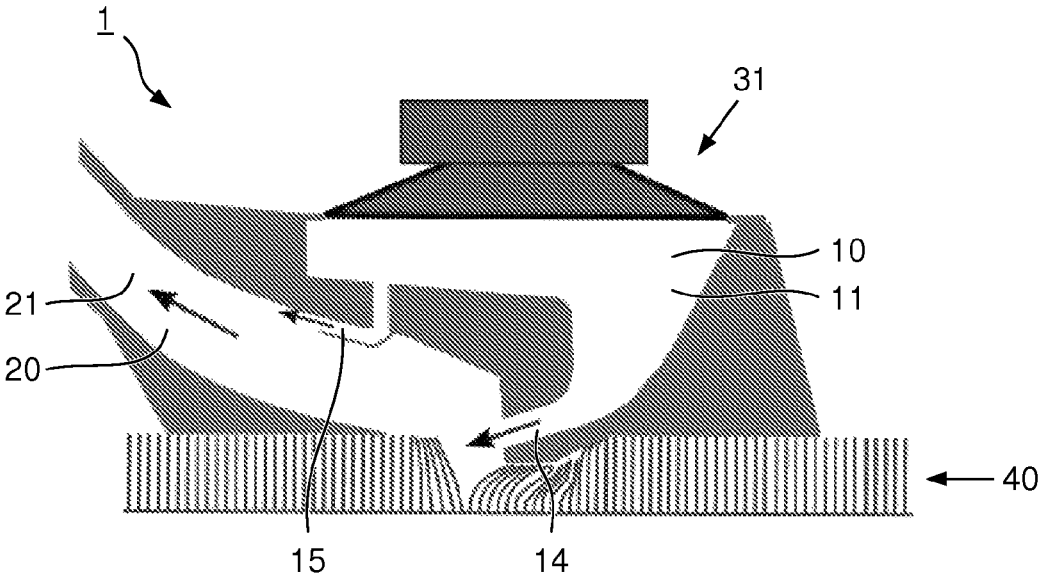
FIG. 10 diagrammatically shows a sectional view of a seventh practical embodiment of the unit.

In the embodiment of the vacuum cleaning unit 1 in which the jet is directed towards the carpet 40 during use, it is possible that the synthetic jet generator 31 for generating the jet flow above the lip 43 is positioned at a relatively large distance from the lip 43 and its surroundings, as described on the basis of FIG. 7. Also, in this embodiment, there may be an additional flow channel 15 between the internal space 11 of the jet generator housing 10 and the internal space 21 of the suction channel housing 20, as described on the basis of FIG. 5. This application of an additional flow channel 15 is illustrated in FIG. 10.

A suitable angle for the jet that is directed away from the carpet 40 is approximately 25° with respect to the carpet 40, and a suitable angle for the jet that is directed towards the carpet 40 is approximately 25° with respect to the carpet 40 as well. In general, it is preferred if the angles as mentioned are in a range from 0° to 40°. Speaking in terms of the vacuum cleaning unit 1, the angles as mentioned are determined with respect to the planar portion 42 of an exterior surface of the unit 1 which is used for facing the carpet 40 and allowing the unit 1 to be positioned right above the carpet 40. For sake of clarity, in FIG. 2, the angle of the jet that is directed away from the carpet 40, i.e. the angle of the orientation of the flow channel 14 with respect to the planar portion 42 of the exterior surface of the unit 1 shown in FIG. 2, is indicated by means of a. Furthermore, in FIG. 9, the angle of the jet that is directed towards the carpet 40, i.e. the angle of the orientation of the flow channel 14 with respect to the planar portion 42 of the exterior surface of the unit 1 shown in FIG. 2, is indicated by means of β. Finally, in respect of the angles α, β, it is noted that experiments which have been conducted in the context of the present invention have shown that very good dust removal results are obtained when the jet is directed away from the carpet at an angle α of 25°.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

In this text, only the word "dust" is used for indicating particles that may be removed from a surface 40 to be cleaned by using the vacuum cleaning unit 1 according to the present invention. For sake of completeness, it is noted that the present invention is applicable for removing many types of particles, including particles which would normally be referred to than dirt particles rather than dust particles, and which are all assumed to be covered by the use of the word "dust" in this text.

A normal use of the vacuum cleaning device according to the present invention is a use in a normal environment, in which air is surrounding the device. Nevertheless, the present invention is also applicable in case another gas than air is present in the direct vicinity of the vacuum cleaning device. Therefore, it is noted that "air" in this text and the attached claims should be understood such as to represent any possible gas that can be used in the sucking/blowing action that is performed when the unit 1 which is part of the vacuum cleaning device according to the present invention is operated.

The present invention can be summarized as follows. In general, the present invention provides a way for locally inducing an oscillating high velocity airflow at a nozzle of a vacuum cleaning device for dislodging dust. Essentially, this airflow is not generated by a fan at a position in a dust collection point, as is the case with conventional vacuum cleaning devices, and is thus "separated" from a flow which is needed for transporting the dust, resulting in lower losses and therefore increased efficiency. The oscillating airflow is characterized by having substantially zero net flow, and having an asymmetry between the suction and the blowing phases, such that in the blowing phase a jet (air pulse) is generated. A generator 31 which is needed for generating the oscillating airflow comprises a movable surface 30 which is integrated in a wall 12 of a housing 10 having an internal space 11 and at least one opening 13 for allowing air to flow to and from the internal space 11. The jet can be realized when the so-called Strouhal number Sr, which is found when the frequency f of the movement of the movable surface 30 is multiplied by the characteristic dimension d of the opening 13, and divided by the velocity v of the air in the opening 13, is not higher than a predetermined maximum.

The present invention relates to a vacuum cleaning device which is equipped with a unit 1 for aerodynamically affecting dust particles and/or a surface 40 to be cleaned in order for the particles to become dislodged from the surface 40 and to become airborne, wherein the unit 1 comprises a housing 10 having an internal space 11 enclosed by a housing wall 12 in which at least one opening 13 is arranged, a movable surface 30 which is integrated in the housing wall 12, and means for actuating the movable surface 30, which are adapted to realize an oscillating movement of the surface 30 that causes air to alternately be drawn into the housing 10 through the opening 13 from various directions at the opening 13, and expelled from the housing 10 through the opening 13 in the form of a directed jet.

Furthermore, the present invention relates to a unit 1 for use in a vacuum cleaning device, for aerodynamically affecting dust particles and/or a surface 40 to be cleaned in order for the particles to become dislodged from the surface 40 and to become airborne, comprising a housing 10 having an internal space 11 enclosed by a housing wall 12 in which at least one opening 13 is arranged, a movable surface 30 which is integrated in the housing wall 12 and means for actuating the movable surface 30, which are adapted to realize an oscillating movement of the surface 30 that causes air to alternately be drawn into the housing 10 through the opening 13 from various directions at the opening 13, and expelled from the housing 10 through the opening 13 in the form of a directed jet.

Also, the present invention relates to use in a vacuum cleaning device of a unit 1 comprising a housing 10 having an internal space 11 enclosed by a housing wall 12 in which at least one opening 13 is arranged, a movable surface 30 which is integrated in the housing wall 12, and means for actuating the movable surface 30, which are adapted to realize an oscillating movement of the surface 30 that causes air to alternately be drawn into the housing 10 through the opening 13 from various directions at the opening 13, and expelled from the housing 10 through the opening 13 in the form of a directed jet, for aerodynamically affecting dust particles and/or a surface 40 to be cleaned in order for the particles to become dislodged from the surface 40 and to become airborne.

The invention claimed is:

1. Vacuum cleaning device, comprising a unit for aerodynamically affecting dust particles and/or a surface to be cleaned in order for the particles to become dislodged from the surface and to become airborne, wherein the unit comprises a housing having an internal space enclosed by a housing wall in which at least one opening is arranged, a movable surface which is integrated in the housing wall, and means for actuating the movable surface, which are adapted to realize an oscillating movement of the surface that causes air to alternately be drawn into the housing through the opening from various directions at the opening, and expelled from the housing through the opening in the form of a directed jet.

2. Vacuum cleaning device according to claim 1, wherein, in the unit, the actuating means are adapted to realize a movement of the surface with characteristics for ensuring that the following criterion is met:

in which f is a frequency of the movement of the surface, d is a characteristic dimension of the opening, and v is an average velocity of the air in the opening in an outflow phase of a cycle of drawing in and expelling air.

3. Vacuum cleaning device according to claim 1, wherein, in the unit, the opening is an axis-symmetric opening, and wherein the actuating means of the unit are adapted to realize a movement of the surface with characteristics for ensuring that the following criterion is met:

in which f is a frequency of the movement of the surface, d is a diameter of the opening, and v is an average velocity of the air in the opening in an outflow phase of a cycle of drawing in and expelling air.

4. Vacuum cleaning device according to claim 1, wherein, in the unit, the opening has an elongated rectangular shape, and wherein the actuating means are adapted to realize a movement of the surface with characteristics for ensuring that the following criterion is met:

in which f is a frequency of the movement of the surface, d is a length of a short side of the opening, and v is an average velocity of the air in the opening in an outflow phase of a cycle of drawing in and expelling air.

5. Vacuum cleaning device according to claim 1, wherein, in the unit, the housing comprises a tube-shaped portion, and wherein the opening is present at an end thereof.

6. Vacuum cleaning device according to claim 1, wherein the unit comprises means for guiding air that is expelled from the housing during operation toward the opening and in a direction of another portion of the unit, and a planar area at the outside for guiding the unit over a surface to be subjected to a vacuum cleaning process, wherein the guiding means are orientated at an angle ($\alpha$) which is in a range from 0° to 40° with respect to the planar area as mentioned.

7. Vacuum cleaning device according to claim 1, wherein the unit comprises means for guiding air that is expelled from the housing during operation toward the opening and in a direction to the outside of the unit, and a planar area at the outside for guiding the unit over a surface to be subjected to a vacuum cleaning process, wherein the guiding means are orientated at an angle ($\beta$) which is in a range from 0° to 40 ° with respect to the planar area as mentioned.

8. Vacuum cleaning device according to claims 1, wherein the unit comprises a projection that is arranged at the outside of the unit, at an opening for allowing access to the inside of the unit.

9. Vacuum cleaning device according to claim 1, wherein, in the unit, the housing comprises two times an internal space enclosed by a housing wall in which at least one opening is arranged, wherein a portion of the housing wall is arranged inside of the housing and constitutes a separation between the two internal spaces, and wherein the movable surface is arranged in that particular housing wall portion.

10. Vacuum cleaning device according to claim 1, wherein the unit comprises an additional housing having an internal space enclosed by a housing wall in which at least one opening is arranged, wherein the internal spaces of the housings are in communication with each other through the openings.

11. Vacuum cleaning device according to claim 10, wherein each of the housings has two openings, and wherein the internal spaces of the housings are in communication with each other through these openings, i.e. at two positions.

12. Vacuum cleaning device according to claim 10, wherein a portion of the wall of the additional housing is recessed at the inside of the housing.

13. Vacuum cleaning device according to claim 10, wherein the additional housing has an opening that is open to a space outside of the unit.

14. Unit for use in a vacuum cleaning device, for aerodynamically affecting dust particles and/or a surface to be cleaned in order for the particles to become dislodged from the surface and to become airborne, comprising a housing having an internal space enclosed by a housing wall in which at least one opening is arranged, a movable surface which is integrated in the housing wall, and means for actuating the movable surface, which are adapted to realize an oscillating movement of the surface that causes air to alternately be drawn into the housing through the opening from various directions at the opening, and expelled from the housing through the opening in the form of a directed jet.

15. Use in a vacuum cleaning device of a unit comprising a housing having an internal space enclosed by a housing wall in which at least one opening is arranged, a movable surface which is integrated in the housing wall, and means for actuating the movable surface, which are adapted to realize an oscillating movement of the surfaced that causes air to alternately be drawn into the housing through the opening from various directions at the opening, and expelled from the housing through the opening in the form of a directed jet, for aerodynamically affecting dust particles and/or a surface to be cleaned in order for the particles to become dislodged from the surface and to become airborne.

* * * * *